US006558085B1

(12) United States Patent
Hall

(10) Patent No.: US 6,558,085 B1
(45) Date of Patent: May 6, 2003

(54) MINE SUPPORT AND METHOD OF FORMING THE SAME

(76) Inventor: Alethea Rosalind Melanie Hall, Plot 40, Dawn Farm, Driefontein, 1747, Muldersdrift (ZA)

( * ) Notice: Subject to any disclaimer, the term of this patent is extended or adjusted under 35 U.S.C. 154(b) by 0 days.

(21) Appl. No.: 09/786,083

(22) PCT Filed: Sep. 2, 1999

(86) PCT No.: PCT/IB99/01497

§ 371 (c)(1),
(2), (4) Date: Apr. 24, 2001

(87) PCT Pub. No.: WO00/14384

PCT Pub. Date: Mar. 16, 2000

(30) Foreign Application Priority Data

Sep. 3, 1998 (ZA) ..... 98/8069

(51) Int. Cl.[7] ..... E21D 15/02

(52) U.S. Cl. ..... 405/288; 405/289; 428/116; 428/117; 428/188

(58) Field of Search ..... 405/288, 289, 405/295, 302.1; 428/116–118, 179, 180, 182, 184, 188, 194; 299/11, 12; 52/741.11, 741.15, 793.11, 799.11, 799.12

(56) References Cited

U.S. PATENT DOCUMENTS

| | | | | | |
|---|---|---|---|---|---|
| 533,498 | A | * | 2/1895 | Rowell | 404/134 |
| 1,982,110 | A | * | 11/1934 | Keown | 404/40 |
| 3,345,284 | A | * | 10/1967 | Turzillo | 53/741.15 X |
| 3,974,789 | A | * | 8/1976 | de Groot | 114/256 |
| 4,425,057 | A | | 1/1984 | Hahn | |
| 4,717,283 | A | * | 1/1988 | Bach | 405/17 |
| 4,770,564 | A | * | 9/1988 | Dison | 405/288 |
| 4,778,309 | A | * | 10/1988 | Bach et al. | 428/117 X |
| 4,797,026 | A | * | 1/1989 | Webster | 428/117 X |
| 4,804,293 | A | * | 2/1989 | Varkonyi et al. | 428/118 X |
| 4,983,077 | A | * | 1/1991 | Sorge et al. | 405/288 |
| 5,308,196 | A | * | 5/1994 | Frederick | 405/288 |
| 5,540,972 | A | * | 7/1996 | Jaegers et al. | 428/116 |

FOREIGN PATENT DOCUMENTS

| | | | |
|---|---|---|---|
| EP | 0191570 | 8/1986 | |
| EP | 0378309 | 7/1990 | |
| GB | 2131850 | 6/1984 | |
| GB | 2137256 | * 10/1984 | 405/288 |
| GB | 2186607 | * 8/1987 | 405/288 |
| WO | 9716604 | 9/1997 | |

* cited by examiner

*Primary Examiner*—Jong-Suk (James) Lee
(74) *Attorney, Agent, or Firm*—Ladas & Parry

(57) ABSTRACT

A method of forming a mine support capable of bearing an axial compressive load involves providing an outer container arranged in use to define a base. There is located within the container a tube of a flexible material divided by dividing walls of a flexible material into an array of compartments running the length of the tube. The compartments are arranged in rows and columns so that the tube divided by the dividing walls has a honeycomb structure. A first end of the tube is positioned in use on the container base and a second end of the tube. One or more of the compartments at or near the center of the tube are filled with a first load bearing material, for example a cementitious grout, to form a pillar with a load bearing capability. The remainder of the compartments of the tube are filled with a second material having no or a lower load bearing capability to form the mine support.

24 Claims, 4 Drawing Sheets

MINE SUPPORT AND METHOD OF FORMING THE SAME

BACKGROUND TO THE INVENTION

This invention relates to a method of forming a mine support to a mine support so formed, and to elements for use in its construction.

It is well known to form support structures such as roadways, canals or river or bank linings and the like from a material having a honeycomb structure i.e having a plurality of compartments or cells divided by dividing walls, each compartment or cell being filled with a suitable filler material. Examples of such materials for use in the support structure Hyson-Cells from M & S Technical Consultants & Services (Proprietary) Limited, Geoweb from Presto Products Company, Tenweb from Tenax Corporation, Armater from Crow Company, Terracell from Webtech Inc, Envirogrid from Akzo Nobel Geosynthetics Co, and Geocells from Kaytech.

This elongate tube of a flexible plastics material has also been used as a mine support capable of bearing a compression load as disclosed in South African Patent No 86/0510.

However, there is always a need for new methods of utilising this tube material.

SUMMARY OF THE INVENTION

According to a first aspect of the invention there is provided a method of forming a mine support capable of bearing an axial compressive load, the method comprising the steps of:

(1) providing an outer container arranged in use to define a base;

(2) locating within the container a tube of a flexible material divided by dividing walls of a flexible material into an array of compartments or cells running the length of the tube, the compartments being arranged in rows and columns so that the tube divided by the dividing walls has a honeycomb structure, with a first end of the tube positioned in use on the container base and a second end of the tube above the first end of the tube;

(3) filling one or more of the compartments at or near the centre of the tube with a first load bearing material to form a pillar with a load bearing capability in or near the centre of the tube; and (4) filling the remainder of the compartments of the tube with a second material having no or a lower load bearing capability than the first load bearing material, to form the mine support.

The outer container may be a bag or a box or the like.

When the outer container is a bag it may be a bag conventionally used in the manufacture of mine supports and may be of any size or shape to suit a particular stope. The term "bag" includes those large bags known as paddocks.

The bag may be woven or non-woven, water impermeable or permeable and made from any suitable material. Examples are polypropylene or the like, or a plastic which is designed to weep. The bag typically includes at least one inlet for introducing filler material into the tube and the bag.

When the outer container is a box, it may be a rigid or semi-rigid box, which is designed to remain part of the mine support when formed, or to disintegrate. For example the box may be a cardboard box.

The cross-sectional size of the compartments in the tube may vary. For example the cross-sectional size of the compartments at or near the centre of the tube may be smaller than the cross-sectional size of the remainder of the compartments. The cross-sectional size of a compartment is the cross-sectional area thereof at right angles to the axis of the compartment.

The mine support may comprise two or more tubes located side by side in the container.

For example, the mine support may comprise two tubes located adjacent opposed ends of the container.

In this version of the invention, the two tubes are spaced apart in the outer container so that a compartment is defined between the two tubes, the compartment being filled with the second material in step (4).

The mine support may also comprise two or more tubes located one on top of another in the container, the compartments in each tube being of the same cross-sectional size, or the compartments in each tube being of different cross-sectional size.

For example, the mine support may comprise three tubes located one on top of another, with the compartment in the first tube on the base in use having a first cross-sectional size, the compartments in the next adjacent second tube having a second cross-sectional size smaller than the cross-sectional size of the compartments in the first tube, and the compartments in the next adjacent third tube having a third cross-sectional size smaller than the cross-sectional size of the compartments in the second tube.

A sheet of a mesh material or the like may be located between each of the tubes located on the top of another, to reinforce the mine support.

The use of compartments with different cross-sectional sizes is described in more detail in co-pending application PCT/IB 99/00967 which is incorporated herein by reference.

Each tube is preferably secured inside the container, for example by attaching the corners of each tube to the container. In one version, a simple tab or string is provided at each corner of each tube for attaching the tubes to the relevant position of the container.

Alternatively, each tube may be secured inside the container by means of a series of flexible strings or rigid stays located through suitable rows and columns of compartments generally at or near the edges of each tube, which flexible strings or rigid stays are attached to the container or to fixed objects to support the tube with the first end of the tube on the base and the second end of the tube above the first end.

Thus, for example, when a tube is substantially rectangular in plan view, a string or a stay may be located in at least a row or a column of compartments at or near each of the four edges of the tube.

The use of flexible strings or rigid stays to support a tube in position is described in more detail in co-pending application PCT/IB 99/00965, which is incorporated herein by reference.

Further alternatively, the outer walls of the tube may be sufficiently rigid so that the tube is self-supporting.

The tube and the dividing walls may be made from any suitable flexible material. Although the material must possess some degree of flexibility, the degree of flexibility may range from very flexible up to semi-rigid. The flexible material may be for example a plastics material such as for example a co-extruded or a bi-axially extruded plastics material; a plastics mesh material; a plastics laminate material such as for example a laminate of a plastics material and a metallic material or a textile material; a metallic material; a woven or non-woven textile material; a paper or cardboard material; and the like.

The flexible material is preferably a suitable plastics material.

Each tube may have any suitable height and any suitable compartment size. For example, the height of the tube may range from 50 mm to 10 m and each compartment may have a wall length of from 5 mm up to 4 m.

The tube may be shaped, e.g by cutting the compartments in one or more rows or columns at an angle to fit into a desired space, e.g a sloping stope or the like.

Generally, the tube is located with the second end of the tube above the first end of the tube so that a second end of each compartment is substantially directly above a first end of the compartment, i.e the axes of the compartments in the tube are substantially vertical. However, the tube may also be located with the second end of the tube above the first end of the tube so that a second end of each compartment is not directly above a first end of the compartment, i.e the axes of the compartments are at an angle to the vertical. This may be achieved by cutting the compartments at an angle, or by manufacturing the compartments at an angle. This may assist in retaining the first load bearing material and the second material in the compartments.

The compartments in the tube may have any suitable cross-section, such as triangular, square, hexagonal or octagonal, but preferably have a square cross-section, i.e each compartment is defined by four walls of substantially equal length.

A wall or walls of each compartment may include one or more hollow protrusions or one or more hollow recesses or both, for interlocking of adjacent compartments. This is described in more detail in co-pending application PCT/IB 99/00964 which is incorporated herein by reference.

The walls of the tube and the dividing walls may include one or more holes or apertures so that filler material can flow from one compartment to another.

In another embodiment, the or each tube may be so designed as to provide a path for circulating a fluid from a first end to a second end of the tube. In this case, each tube will include first flow means at or near the first end of the tube, and either in the dividing walls between the first and second rows and between the third and fourth rows and between each succeeding pairs of rows, or in the dividing walls between the second and third rows and between the fourth and fifth rows and between each succeeding pair of rows; and second flow means at or near the second end of the tube, and either in the dividing walls between the second and third rows and between the fourth and fifth rows and between each succeeding pairs of rows, or in the dividing walls between the first and second rows and between the third and fourth rows and between each succeeding pairs of rows, so that the first flow means and the second flow means alternate.

In this way, a fluid such as mine water may be circulated through the tube, e.g mine water introduced through a fluid inlet at a first end of the tube flowing either up or down the compartments in the first row, through the first or second flow means between the first and second rows, and then down or up the compartments in the second row, through the second or first flow means between the second and third rows, and so on until the water reaches the fluid outlet. This is possible even though certain of the compartments at or near the centre of the tube are filled with the first load bearing material, in that other compartments will be filled with the second material, which permits the flow of the water therethrough.

Apparatus for circulating a fluid as discussed above, is described in more detail in co-pending application PCT/IB 99/01396 which is incorporated herein by reference.

The first load bearing material is typically formed of cementitious grout, crusher sand or cemented slimes or tailings, or the like so that the central pillars have sufficient load bearing capabilities.

The second material may have no load bearing capability, e.g it may be a filter material as described in more detail below, or may have a lower load bearing capability than the first load bearing material.

The second material, when it is to be load bearing, is typically back fill or mine slimes or tailings or similar material having a much lower load bearing capability, or a foamed material to help control of the collapse of the mine support in use.

As mentioned above, the second material may also be a filter material such as for example lime or limestone powder, rocks or blocks, to neutralise mine water flowing therethrough; activated carbon or wire wool for neutralising components in the mine water; pebbles or stones; sand; and the like.

In a further embodiment of the invention, a side of the mine support may incorporate a blast curtain. The blast curtain may be releasably or permanently attached to the mine support, i.e to an outside wall of the outer container.

In a further embodiment of the invention, one or more reinforcing straps or rings or the like may be located around either the outside of the tube or tubes inside the outer container, or around the outside of the outer container, to support the mine support in use.

According to a second aspect of the invention there is provided a mine support formed as described above.

According to a third aspect of the invention there is provided a mine support unit comprising an outer container having at least one filler port or inlet and defining a base in use and a tube of a flexible material divided by dividing walls of a flexible material into an array of compartments or cells running the length of the tube, the compartments being arranged in rows and columns so that the tube divided by the dividing walls has a honeycomb structure, with a first end of the tube positioned in use on the outer container base and a second end of the tube above the first end of the tube, the unit being adapted to receive in use filler material to form a mine support, as described above.

DESCRIPTION OF EMBODIMENTS

The crux of the invention is a method of forming a mine support, and a mine support so made. This will be described in more derail by way of example only, with reference to the accompanying drawings.

Figure 1:
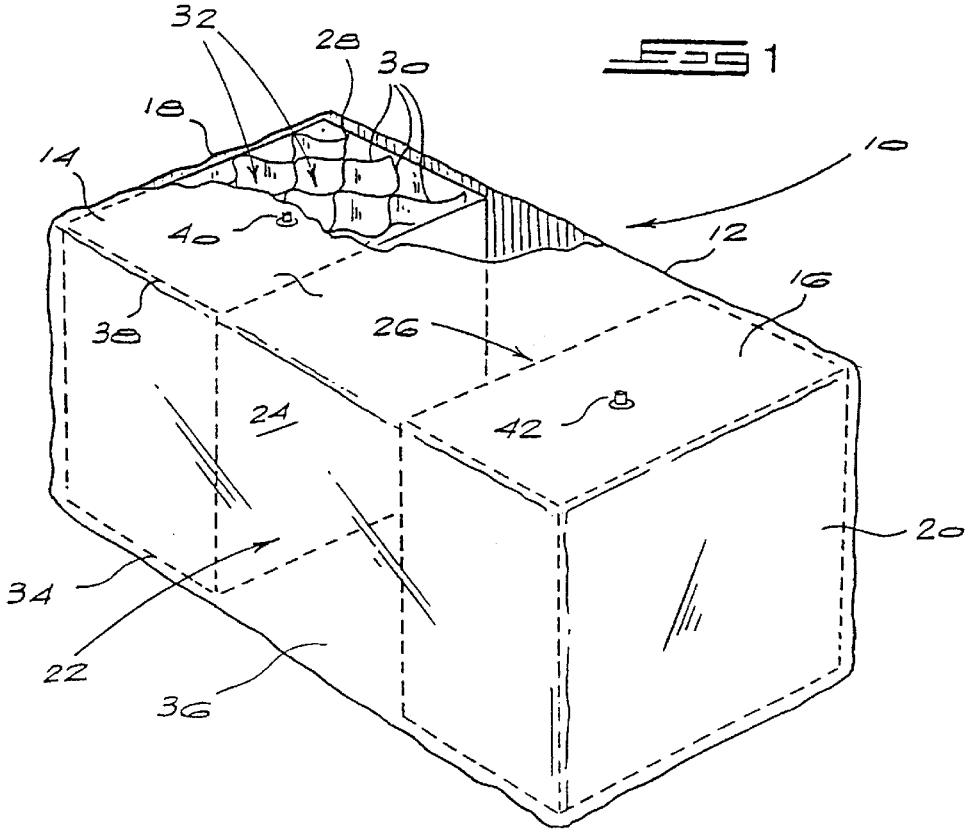
FIG. 1 is a perspective view of a first mine support unit of the invention.
Figure 2:
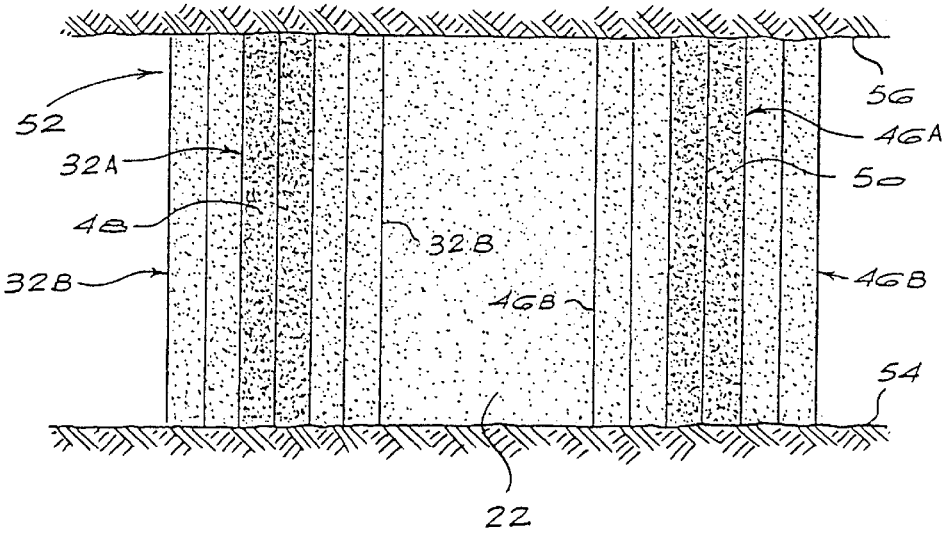
FIG. 2 is a schematic side view of the first mine support of the invention in use.

Referring to FIGS. 1 and 2 of the accompanying drawings, there is shown a mine support unit 10 comprising an outer bag 12 and a pair of support members 14 and 16 located within the bag 12 adjacent respective ends 18 and 20 of the bag 12. A compartment 22 is defined between the sides 24 and 26 of the spaced apart respective support members 14 and 16.

The support member 14, and likewise the support member 16, consists of a tube 28 of a flexible material divided by dividing walls 30 into an array of compartments 32 running the length of the tube 28. The compartments 32 are arranged in rows and columns so that the tube 28 divided by the dividing walls 30 has a honeycomb structure. A first end 34 of the tube 28 is located on the base 36 defined by the outer bar 12 in use and a second end 38 located above the first end 34.

The bag 12 includes an inlet 40 positioned near the end 18 of the bag 12 so as to allow filler material to be introduced into the tube 28. Likewise, an inlet 42 is provided adjacent ends 20 of the bag 12 for introducing filler material into the tube 44 of support member 16.

In use, one or more of the compartments 32A and 46A at the centre of respective tubes 28 and 44 are filled with a first load bearing material, for example a cementitious grout, slimes modified with suitable chemicals, mine tailings, ash or crusher sand or the like so that central pillars 48 and 50, as shown in FIG. 2, with suitable load bearing capabilities are formed in the respective tubes 28 and 44. These central pillars 48 and 50 provide initial load bearing capacity to the mine support 52.

Thereafter the remainder of the compartments 32B and 46B are filled with a second load bearing material in the binder backfill or mine slimes or some other material which has a much lower load bearing capacity. Once the compartments 32B and 34B of the respective tubes 28 and 44 are filled, the slimes or backfill will then spill over into the central compartment 22 between the two tubes 28 and 44. The filling process is continued until the whole bag 12 is filled with filler material.

The whole may be vibrated using, for example, a poker vibrator, during or after filling, to assist in densification of the second load bearing material. In this case the outer bag 12 may include a valve or the like, at or near the top thereof, to allow water to escape from the outer bag 12 as the second load bearing material settles and densifies.

As an alternative, water may be sucked out of the outer bag 12, at or near the bottom thereof to compact the second load bearing material.

As illustrated, the formed mine support 52 is suitable for use in an underground mine and may be positioned between a mine floor 54 and wall overhang 56 to provide load bearing support for the overhand 56. The bag 12 may be provided in any shape or size to suit the particular stope.

The method of filling one or more compartments with the first load bearing material and of filling one or more compartments with the second material may be any method commonly used, such as for example pumping the material (through a suitable inlet or opening in the outer container) into the relevant compartments.

Figure 3:
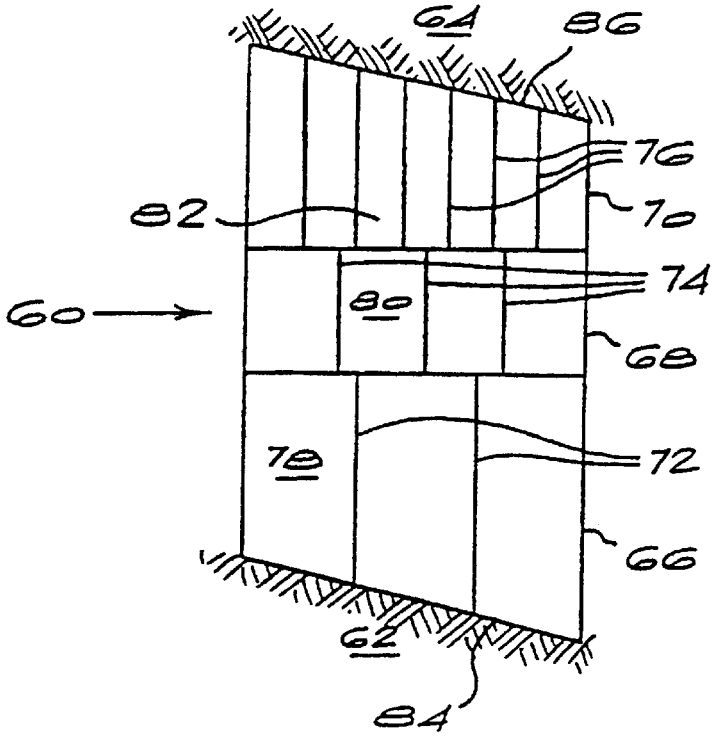
FIG. 3 is a schematic side view of a second mine support of the invention.

Referring to FIG. 3 there is shown a mine support 60 positioned between a mine floor 62 and a wall overhang 64 to provide load bearing support for the wall overhang 64. The mine support 60 is formed from three separate tubes 66, 68, 70 each comprised of a flexible material divided by dividing walls 72. 74, 76 into an array of compartments 78, 80, 82 running the length of the tube 66, 68, 70. It can be seen that the cross-sectional size of the compartment 78 in the tube 66 is greater than the cross-sectional size of the compartments 80 in the tube 68, which in turn are of a greater cross-sectional size than the compartment 82 in the tube 70.

It is also to be noted that the bottom 84 of the tube 66 and the top 86 of the tube 70 are cut at an angle to accommodate the slope of the mine floor 62 and wall overhang 64.

The three tubes 66, 68, 70 are all located within an outer container (not shown). The three tubes 66, 68, 70 and the outer container may be supported in position between the mine floor 62 and wall overhang 64 in any suitable manner, prior to steps (3) and (4) of the method of the invention. For example the outer container may be attached to the wall overhang 64 and the tubes 66, 68, 70 may then be attached to the outer container by flexible strings.

In use, one or more of the compartments 78, 80, 82 at or near the centre of the tubes 66, 68, 70 is filled with a first load bearing material so that a central pillar with suitable load bearing capabilities is formed, and thereafter the remainder of the compartments 78, 80, 82 are filled with a second load bearing material which has a lower load bearing capability. The result is a mine support 60 for supporting the wall overhang 64.

Figure 4:
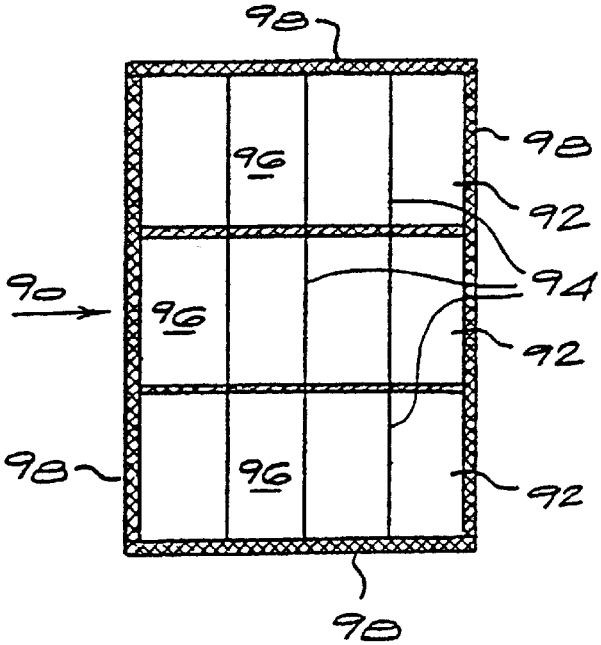
FIG. 4 is a schematic side view of a third mine support of the invention.

Referring to FIG. 4 there is shown a mine support 90, again for location in position between a mine floor and a wall overhang (not shown). The mine support 90 is formed from three tubes 92 of a flexible material divided by dividing walls 94 of a flexible material into an array of compartments 96 running the lengths of the tubes 92. The compartments 96 in the three tubes are all of the same cross-sectional size.

Located between each of the tubes 96, and on the outer sides and the top of the series of tubes 92 are layers 98 of a mesh material, which serve the purpose of reinforcing the mine support 90.

The compartments 96 of the tubes 92 may be filled with first and second load bearing materials as described above.

Figure 5:
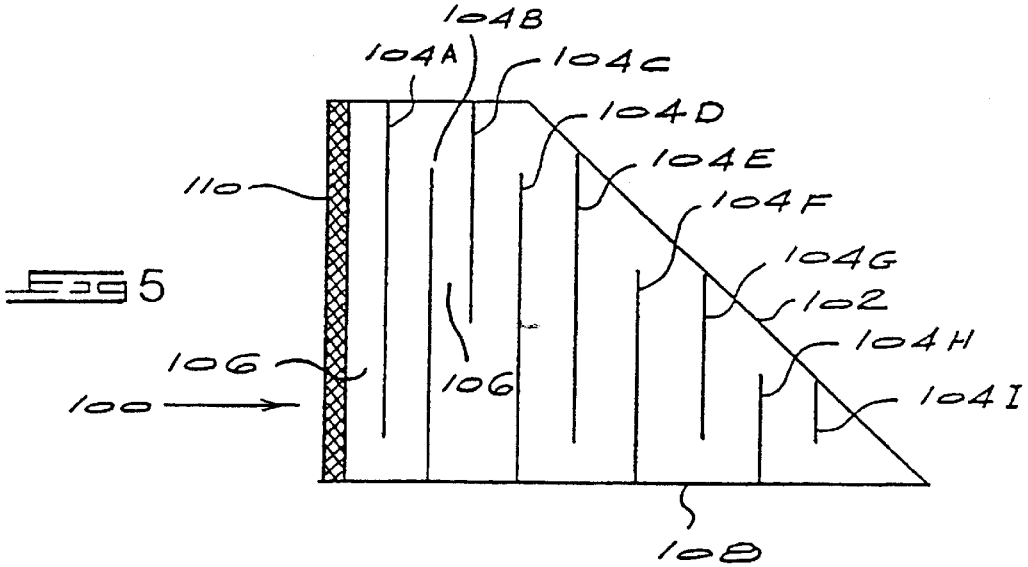
FIG. 5 is a schematic side view of a fourth mine support of the invention.
Figure 6:
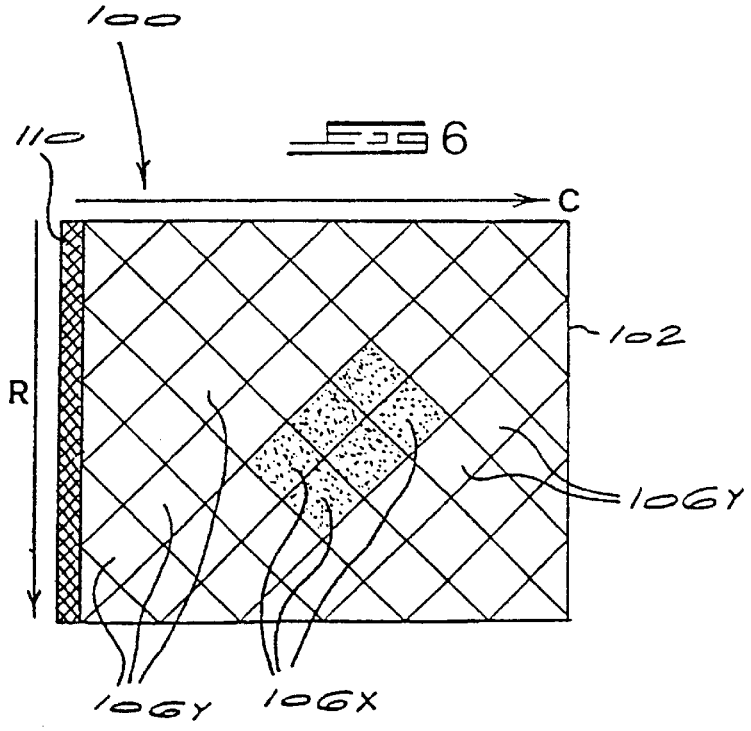
FIG. 6 is a plan view of the fourth mine support of FIG. 5.

Referring to FIGS. 5 and 6 there is shown a mine support 100, again for location between a mine floor and wall overhang (not shown). The mine support 100 is designed not only to support the wall overhang, but also to filter mine water passing therethrough, as will be described in more detail below.

The mine support 100 is formed from a tube 102, located within an outer container (not shown). The tube 102 of a flexible material is divided by dividing walls 104 of a flexible material into an array of compartments 106 running the length of the tube 102. The compartments 106 are arranged in rows running in the direction of the arrow R and columns running in the direction of the arrow C so that the tube 102 divided by dividing walls 104 has a honeycomb structure.

It can be seen that the dividing wall 104A between the first and second rows of compartments 106 and likewise the dividing walls 104C, 104E, 104G and 104I between the third and fourth rows of compartments 106, and the fifth and sixth row of compartments 106, and so on, are each spaced from the base 108. These walls 104A, 104C, 104E, 104G and 104I also extend above the dividing walls 104B, 104D, 104F and 104H as illustrated. Further, the dividing walls 104B, 104D, 104F and 104H are attached to the base 108. This permits circulation of mine water through the mine support 100.

In use, compartments 106X at or near the centre of the mine support 100 are filled with a first load bearing material, such as for example concrete, to form a central pillar with load bearing capabilities. The remainder of the compartments 106Y are filled with a second material for filtering mine water, such as for example sand.

Mine water introduced into the first row of compartments 106 passes down the compartments 106 in the first row, under the dividing wall 104A, up the compartments 106 in the second row, over the dividing wall 104B, and so on until it exits the mine support. Suspended solids in the water are trapped in the compartments 106Y. The mine water flows around the compartments 106X which are filled with the first load bearing material.

The mine support 100 also incorporates a blast barricade 110 to protect the mine support 100 from blasts in use.

Figure 7:
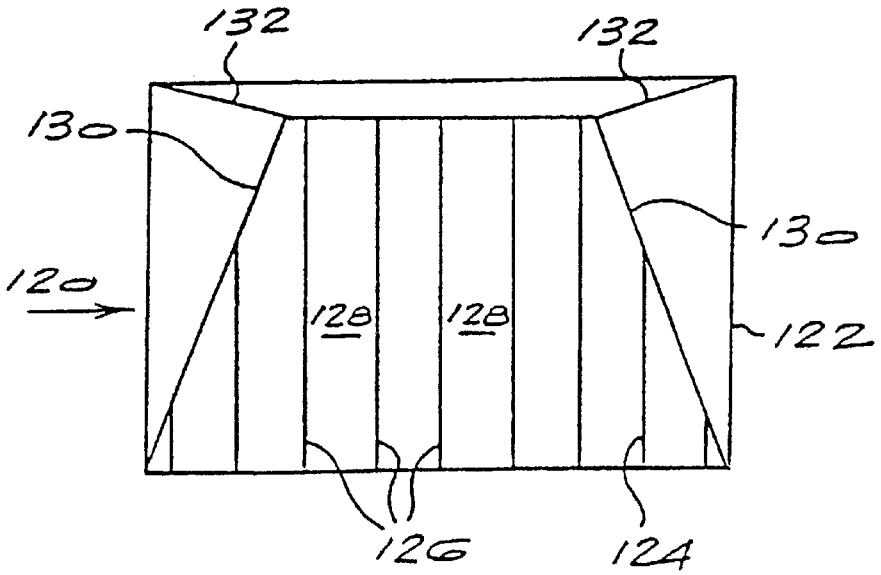
FIG. 7 is a schematic side view of a fifth mine support of the invention.

Referring to FIG. 7, there is shown a mine support 120, again for location between a mine floor and a wall overhang (not shown). The mine support 120 consists of an outer box 122, for example a cardboard box, in which is located a tube 124. The tube 124 is made of a flexible material divided by dividing walls 126 into an array of compartments 128 running the length of the tube 124. The sides 130 of the tube 124 are cut at an angle as illustrated to save on material requirements.

The tube 124 is supported in position in the box 122 by means of flexible strings 132 attached to the corners of the tube 124 and then attached to the box 122.

Again, one or more of the compartments 128 at the centre of the tube 124 is filled with a first load bearing material to form a central load bearing pillar, while the remainder of the compartments 128 are filled with a second material with a lower load bearing capacity, to form the mine support 120.

Although various types of mine support of the invention are illustrated, other variations may also be included. For example, one or more of the compartments of the tube of the mine support may include as an insert a support member adapted to receive a load initially, and also to support the tube, for example a pipe or a wooden pole or the like.

In another embodiment of the invention, where the mine support is formed from a number of tubes located one on top of another, the outer walls of each tube may include an extension or petticoat which, in use, is folded inwardly, to prevent the egress of filler material from the outer compartments of the tubes in use.

In another embodiment of the invention, the tube and dividing walls may be so designed that a wall or walls of each compartment include one or more hollow protrusions or one or more hollow recesses or both, for interlocking of adjacent compartments. This is described in more detail in co-pending application PCT/IB 99/00964 which is incorporated herein by reference.

The mine support of the invention may also be designed to incorporate a material which can act as a fire wall in use. For example, one or more rows or columns of compartments may include a liquid gel, optionally including a foaming agent, which expands when in contact with heat or the like thus constituting a fire wall.

What is claimed is:

1. A method of forming a mine support capable of bearing an axial compressive load comprising the steps of:

(1) providing an outer container arranged in use to define a base;

(2) locating within the container a tube of a flexible material divided by dividing walls of a flexible material into an array of compartments running the length of the tube, the compartments being arranged in rows and columns so that the tube divided by the dividing walls has a honeycomb structure, with a first end of the tube positioned in use on the container base and a second end of the tube above the first end of the tube;

(3) filling one or more of the compartments at or near the centre of the tube with a first load bearing material to form a pillar with a load bearing capability in or near the centre of the tube; and (4) filling the remainder of the compartments of the tube with a second material having no or a lower load bearing capability than the first load bearing material, to form the mine support.

2. A method according to claim 1 wherein the outer container is a flexible bag.

3. A method according to claim 1 wherein the outer container is a rigid or semi-rigid box.

4. A method according to any one of claims 1 to 3 wherein the mine support comprises two or more tubes located side by side in the outer container.

5. A method according to anyone of claims 1 to 3 wherein the mine support comprises two or more tubes located one on top of another in the outer container.

6. A method according to claim 5 wherein the compartments in at least one of the tubes are of a different cross-sectional size to the compartments in at least another of the tubes.

7. A method according to claim 6 wherein a sheet of a mesh material is located between each of the tubes located one on top of another.

8. A method according to claim 5 wherein a sheet of a mesh material is located between each of the tubes located one on top of another.

9. A method according to claim 1 wherein the tube contains compartments of at least two different cross-sectional sizes.

10. A method according claim 1 wherein the tube and the dividing walls are made from a flexible material selected from the group consisting of a plastics material, a plastics laminate material, a metallic material, a woven or non-woven textile material, of a paper and a cardboard material.

11. A method according claim 1 wherein the walls of the tube and the dividing walls include one or more apertures so that the first load bearing material and the second material may flow from one compartment to another.

12. A method according claim 1 wherein the first load bearing material is selected from the group consisting of a cementitious grout, crusher sand and cemented slimes.

13. A mine support capable of bearing an axial compressive load comprising:

an outer container defining a base in use;

a tube of a flexible material divided by dividing walls of a flexible material into an array of compartments running the length of the tube, the compartments being arranged in rows and columns so that the tube divided by the dividing walls has a honeycomb structure, the tube being located within the outer container with a first end of the tube positioned in use on the container base and a second end of the tube above the first end of the tube;

a first load bearing material filled into one or more of the compartments at or near the centre of the tube forming a pillar with a load bearing capability in or near centre of the tube; and a second material having no or a lower load bearing capability than the first load bearing material filling the remainder of the compartments of the tube, to form the mine support.

14. A mine support according to claim 13 wherein the outer container is a flexible bag.

15. A mine support according to claim 13 wherein the outer container is a rigid or semi-rigid box.

16. A mine support according to anyone of claims 13 to 15 wherein the mine support comprises two or more tubes located side by side in the outer container.

17. A mine support according to any one of claims 13 to 15 wherein the mine support comprises two or more tubes located one on top of another in the outer container.

18. A mine support according to claim 17 wherein the compartments in at least one of the tubes are of a different cross-sectional size to the compartments in at least another of the tubes.

19. A mine support according to claim 18 wherein a sheet of a mesh material is located between each of the tubes located one on top of another.

20. A mine support according to claim 17 wherein a sheet of a mesh material is located between each of the tubes located one on top of another.

21. A mine support according to claim 13 wherein the tube contains compartments of at least two different cross-sectional sizes.

22. A mine support according to claim 13 wherein the tube and the dividing walls are made from a flexible material selected from the group consisting of a plastics material, a plastics laminate material, a metallic material, a woven or non-woven textile material, a paper and a cardboard material.

23. A mine support according to claim 13 wherein the walls of the tube and the dividing walls include one or more apertures so that the first load bearing material and the second material may flow from one compartment to another.

24. A mine support according to claim 13 wherein the first load bearing material is selected from the group consisting of a cementitious grout, crusher sand and cemented slimes.

* * * * *